US011162392B2

(12) United States Patent
Stolk et al.

(10) Patent No.: US 11,162,392 B2
(45) Date of Patent: Nov. 2, 2021

(54) VALVE OPERATING DEVICE, IN PARTICULAR FOR AN INTERNAL COMBUSTION ENGINE

(71) Applicant: Daimler AG, Stuttgart (DE)

(72) Inventors: Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 16/650,319

(22) PCT Filed: Aug. 17, 2018

(86) PCT No.: PCT/EP2018/072291
§ 371 (c)(1),
(2) Date: Mar. 24, 2020

(87) PCT Pub. No.: WO2019/063194
PCT Pub. Date: Apr. 4, 2019

(65) Prior Publication Data

US 2020/0217228 A1 Jul. 9, 2020

(30) Foreign Application Priority Data

Sep. 26, 2017 (DE) ..... 10 2017 008 963.9

(51) Int. Cl.
*F01L 1/047* (2006.01)
*F01L 13/00* (2006.01)

(52) U.S. Cl.
CPC ..... *F01L 1/047* (2013.01); *F01L 13/0036* (2013.01); *F01L 13/0005* (2013.01); *F01L 2001/0473* (2013.01); *F01L 2001/0476* (2013.01)

(58) Field of Classification Search
CPC ... F01L 1/047; F01L 13/0036; F01L 13/0005; F01L 2001/0473; F01L 2001/0476; F01L 2013/103; F01L 2013/0052; F01L 2013/101; F01L 2820/031
USPC ..... 123/90.16, 90.6, 90.18
See application file for complete search history.

(56) References Cited

U.S. PATENT DOCUMENTS

| | | | | |
|---|---|---|---|---|
| 8,235,014 B2 * | 8/2012 | Talan | F01L 13/0036 | 123/90.16 |
| 2010/0242884 A1 * | 9/2010 | Meintschel | F01L 1/053 | 123/90.21 |
| 2016/0194984 A1 | 7/2016 | Haga et al. | | |

FOREIGN PATENT DOCUMENTS

| | | |
|---|---|---|
| CN | 105556070 A | 5/2016 |
| CN | 106536878 A | 3/2017 |
| DE | 197 02 389 A1 | 7/1998 |
| DE | 10 2007 042 932 A1 | 3/2009 |

(Continued)

OTHER PUBLICATIONS

PCT/EP2018/072291, International Search Report dated Oct. 24, 2018 (Two (2) pages).

(Continued)

*Primary Examiner* — Patrick Hamo
*Assistant Examiner* — Wesley G Harris
(74) *Attorney, Agent, or Firm* — Crowell & Moring LLP

(57) ABSTRACT

A valve operating device, in particular for an internal combustion engine, has a camshaft, a cam unit mounted in an axially moveably manner on the camshaft, and an actuator unit which has an actuator for displacing the cam unit on the camshaft. The actuator is periodically mechanically forcibly decoupled during operation.

4 Claims, 2 Drawing Sheets

(56) References Cited

FOREIGN PATENT DOCUMENTS

| | | | | | |
|---|---|---|---|---|---|
| DE | 102012209860 | A1 | * | 12/2013 | ..... F01L 13/0036 |
| DE | 102014212997 | A1 | * | 11/2015 | ..... F01L 1/047 |
| DE | 102015012044 | A1 | * | 3/2017 | ..... F01L 1/047 |
| DE | 10 2016 001 537 | A1 | | 8/2017 | |
| DE | 10 2016 012 194 | A1 | | 4/2018 | |
| JP | 59-194015 | A | | 11/1984 | |
| JP | 60-62613 | A | | 4/1985 | |
| JP | 60-62614 | A | | 4/1985 | |

OTHER PUBLICATIONS

Chinese-language Office Action issued in Chinese Application No. 201880062482.X dated Apr. 30, 2021 with partial English translation (eight (8) pages).

* cited by examiner

VALVE OPERATING DEVICE, IN PARTICULAR FOR AN INTERNAL COMBUSTION ENGINE

BACKGROUND AND SUMMARY OF THE INVENTION

The invention relates to a valve operating device, in particular for an internal combustion engine, and a motor vehicle having an internal combustion engine which comprises the valve operating device.

A valve operating device, in particular for an internal combustion engine, is already known from DE 10 2016 012 194, having at least one camshaft, having at least one cam unit mounted axially moveably on the camshaft, and having at least one actuator unit which has at least one actuator for adjusting the cam unit on the camshaft. DE 10 2016 012 194 further comprises a safety device which is provided for triggering a switching operation of a switching unit only in a permissible state. If the safety device fails and an actuator of the switching unit therefore wants to conduct a switching operation at an incorrect time, it can do so. The cam unit can then be moved at an incorrect time, which can result in damage to the valve operating device.

A valve operating device is also known from JPS6062613A. According to JP 60062613, a shift of the cam piece at the wrong time, in particular when the valves are being operated, should be prevented by means of a mechanism. This must be carried out very solidly, as it must block the large displacement forces generated by the actuators.

Furthermore, a valve operating device is also known from DE 10 2007 042 932. In normal operation, there is no interaction between a switching medium and a switching unit if switching is not supposed to occur. A safety device is provided to prevent unplanned interaction. If switching is supposed to occur, the interaction of the switching medium with the switching unit must be established beforehand. This process takes a certain amount of time, in particular approximately a quarter of a camshaft revolution. If the switching command takes place too late, almost a complete camshaft revolution must thus be waited for, until a tracking process is possible. In particular at low engine speeds, the driver thus experiences an unpleasant delay when a load is required. In the sport programme of the vehicle, it must either be driven at an increased speed or permanently with the large valve stroke in order to ensure a spontaneous reaction. Both lead to increased consumption.

In particular, the object of the invention is to provide an advantageously safe and constructively simple valve operating device.

The invention is based on a valve operating device, in particular for an internal combustion engine, having at least one camshaft, having at least one cam unit mounted axially moveably on the camshaft and having at least one actuator unit which has at least one actuator for adjusting the cam unit on the camshaft.

It is provided that the actuator is periodically mechanically forcibly decoupled during operation. Preferably, the valve operating device is in particular provided to establish an operative connection between the actuator and the cam unit in the correct angular position at each camshaft revolution, independent of any switching process that may be pending. In this way, an advantageously safe valve operating device can be provided. Advantageously, a valve operating device can be provided that makes a switching process impossible at the wrong time, which makes the valve operating device particularly safe. The design according to the invention makes it possible to dispense with a comparatively large and solid mechanism that would have to block the displacement forces generated by the switching unit. In particular, a valve operating device can be provided, in which the actuator is always in operative connection with the cam unit when a switching is possible, which is in particular the case in every half camshaft revolution. The actuator can therefore implement every switching requirement without delay. In particular, it is possible to forgo, for example, waiting for a pin to be tracked into a link. Furthermore, it is no longer necessary, for example, for the tracking of a pin into a link to be sensed and verified.

An "internal combustion engine" is to be understood in particular as an engine of a motor- and/or commercial vehicle which, by burning a fuel, such as petrol or diesel, provides a driving energy for driving the corresponding motor- and/or commercial vehicle. A "camshaft" is thereby to be understood in particular as a shaft which is provided for operating several valves of the internal combustion engine and has at least one cam track in each case for operating a valve. It is conceivable that the camshaft is designed as an intake camshaft and is provided to operate intake valves, and also that the camshaft is designed as an exhaust camshaft and is provided to operate exhaust valves. In principle, it would also be conceivable that the camshaft is provided to operate inlet valves and to operate exhaust valves. A "cam track" should be understood in particular as a region running on a periphery of the camshaft, preferably on a periphery of a cam unit, the region forming a valve operating curve for valve operation and/or defining the valve actuation. A "cam unit" is to be understood in particular as a unit which is non-rotatably and preferably axially moveably arranged on a camshaft and, for operating a valve, is provided to apply at least one valve stroke directly or indirectly to the corresponding valve. A "moveably mounted cam unit" is to be understood in particular as a cam unit which is mounted axially on the camshaft and has at least two different cam tracks for a valve to be operated, which preferably have different cam contours. In particular, a "switching unit" is understood to be a unit provided to move a cam unit axially on the camshaft, in order to bring different cam tracks of the cam unit into engagement with the corresponding valve. The switching unit preferably has an actuator and a coupling element connected to the actuator and to the cam unit to be adjusted. An "actuator" is to be understood in particular as a mechatronic component which is provided to convert electrical and/or electronic signals into a movement, in particular, into a rotary and/or linear movement. Here, an actuator is preferably designed as a spindle drive, a pneumatic piston, a hydraulic piston or another actuator that appears useful to a person skilled in the art. This means that the switching unit is in particular provided to shift an axial position of the cam unit. The switching unit for shifting or adjusting the axial position is preferably controlled by a control and/or regulating unit. The term "provided" is to be understood as specially designed, equipped and/or arranged. A "control and/or regulating unit" is to be understood in particular as a unit having at least one electronic control device. An electronic "control device" is to be understood in particular as a unit having a processor unit and having a memory unit as well as having an operating program stored within the memory unit. In principle, the control and/or regulating unit can have several control devices connected to each other, which are preferably provided to communicate with each other via a bus system, in particular a CAN bus system. Depending on the further design, the control and/or regulating unit can also have hydraulic and/or pneumatic components, in particular such as valves. In this context, the statement that the "actuator is periodically mechanically forcibly decoupled during operation" is to be in particular understood to mean that, during operation, an effective connection between the actuator and the cam unit is automatically mechanically interrupted at regular intervals. The decoupling is preferably carried out mechanically without the intervention of a control unit. Particularly preferably, in a forcibly decoupled state, operating the cam unit or a switching operation by the actuator is not technically possible due to a lack of effective connection. The term "periodic" is to be understood in particular as regular intervals, wherein a period can be coupled with a speed of the camshaft. This means, in particular, that a period can change with the speed of the camshaft. This is to be understood, particularly preferably, in regular intervals relative to an angle of rotation and/or an angular position of the camshaft. A "switching operation" is to be understood in particular as an operation in which a cam track engaged with the corresponding valve is switched over to another cam track and this cam track is brought into engagement with the valve. During a switching operation, the unit with the two cam tracks, between which the cam track is moved, is moved axially on the camshaft. A "permissible state" is to be understood in particular as a state of the valve operating device and/or of the internal combustion engine, in which a valve lift switchover can be carried out operationally reliably by switching from one engaged cam track to another cam track.

It is also provided that the actuator is periodically temporarily decoupled from the cam unit during operation, relative to a rotational speed of the camshaft. Preferably, the actuator is periodically temporarily forcibly decoupled from the cam unit during operation, relative to a rotational angle of the camshaft. Preferably, the actuator is always temporarily forcibly decoupled from the cam unit when the cam unit should not be adjusted, i.e., in particular when at least one valve is being operated by the cam unit. In this way, a valve operating device can be provided which makes it constructively impossible to switch at the wrong time, making the valve operating device particularly safe. In particular, a valve operating device can be provided in which the actuator is always in operative connection with the cam unit when switching is possible.

Furthermore, the cam unit has an engagement element by means of which the cam unit is coupled to the actuator unit. Preferably, the actuator and the actuating element are in direct operative connection in at least one operating state. The actuator is preferably provided to transmit an adjusting force to the cam unit via the actuating element. In particular, a reliable transmission of an adjusting force to the cam unit can be achieved. In particular, an advantageous mechanical force transmission can be provided. In this context, an "engagement element" is to be understood in particular as an extension running at least partially in the peripheral direction around the cam unit, which is in direct operative connection with the actuator in at least one operating state. Preferably, the engagement element is formed by a gill running at least partially in the peripheral direction around the cam unit.

It is further provided that the engagement element is partially interrupted along a periphery of the cam unit. Preferably, the engagement element has at least one interruption. Preferably, the at least one interruption extends over at least 5%, preferably at least 15% and particularly preferably at least 25% of a periphery of the cam unit. Particularly preferably, the interruption has an arrangement such that when the interruption faces the actuator, the cam unit is operating a valve. Thus the interruption preferably always faces the actuator when the cam unit should not be adjusted, thus in particular when at least one valve is being operated by means of the cam unit. Preferably, the interruption in a position facing the actuator causes a forced decoupling of the actuator. Preferably, the cam unit is free from an engagement element in the region of the interruption, in this way, a valve operating device can in particular be provided, which makes it impossible to switch at the wrong time, advantageously constructively simple, which makes the valve operating device particularly safe. In particular, a valve operating device can be provided in which the actuator is always in operative connection with the cam unit when switching is possible, which is the case in particular in every half camshaft revolution.

It is further provided that the actuator is temporarily not engaged with the engagement element during operation. Preferably, the actuator is never engaged with the engagement element when the cam unit is not supposed to be adjusted, i.e., in particular when at least one valve is being operated by means of the cam unit. Preferably, the actuator is not adjusted to disengage from the engagement element. In this way, a valve operating device can in particular be provided, which makes it impossible to switch at the wrong time, advantageously constructively simple, which makes the valve operating device particularly safe. In particular, it may have provided a valve operating device in which the actuator is always in operative connection with the cam unit when a switching is possible, which is particularly the case in every half camshaft revolution. Since the valve operating device does not block an incorrect shifting process as after the SdT, but rather makes it impossible to construct shifting forces at the wrong time, the actuator unit can be dimensioned very easily. Faulty switching operations are prevented very reliably.

It is also provided that the engagement element is formed by a crescent-shaped gill. This is particularly advantageous for providing an engagement element which has an interruption. In particular, a constructively simple and easy to manufacture engagement element can be provided. A "crescent-shaped gill" is to be understood in particular as a gill which, in a section plane perpendicular to an axis of rotation of the camshaft, has an at least substantially crescent-shaped, in particular crescent moon-shaped, cross-section. Preferably, the gill has a radial height which, starting from a centre of the gill, decreases in particular continuously to zero in both directions of rotation.

Furthermore, the invention is based on a motor vehicle having an internal combustion engine which comprises the valve operating device.

Further advantages arise from the following Figure description. An exemplary embodiment of the invention is shown in the Figures. The Figures, the Figure description and the claims include numerous features in combination. The person skilled in the art will also expediently look at the features individually and combine them into meaningful further combinations.

DETAILED DESCRIPTION OF THE DRAWINGS

Figure 1:
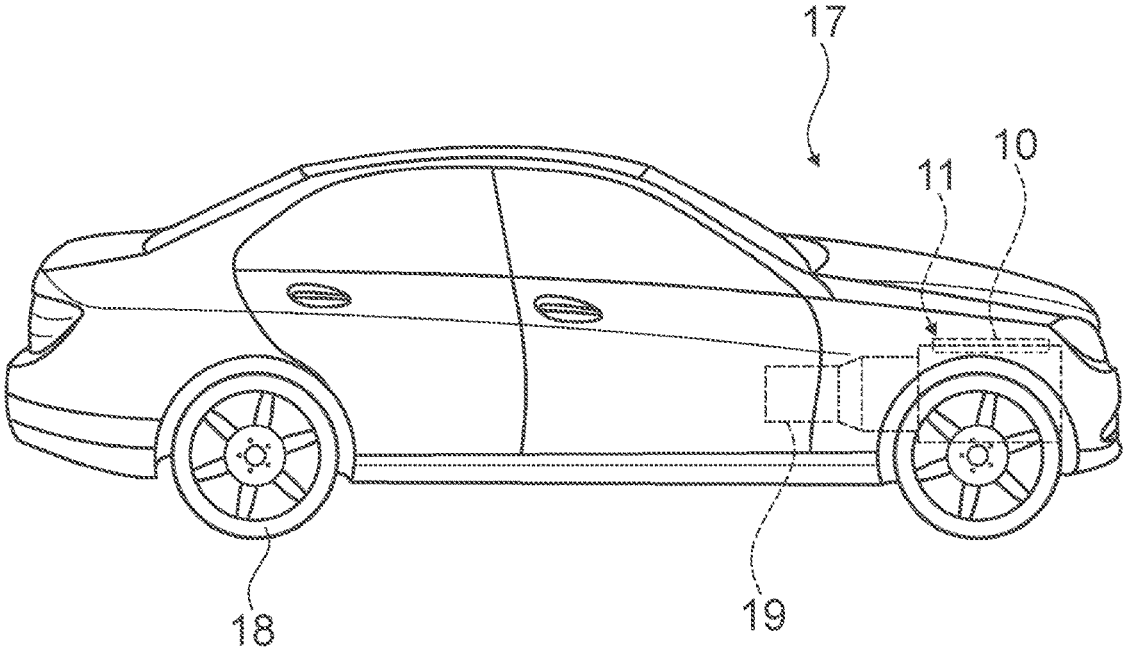
FIG. 1 is a schematic depiction of a motor vehicle having an internal combustion engine which comprises a valve operating device according to the invention, and having a multi-stage transmission in a schematic depiction.

FIG. 1 schematically shows a motor vehicle 17. The motor vehicle 17 comprises a drive train, by means of which the drive wheels 18 not visible in more detail of the motor vehicle 17 are driven. The drive train comprises an internal combustion engine 11, The internal combustion engine 11 is formed by a combustion motor. Furthermore, the motor vehicle 17 has a multi-stage transmission 19. The internal combustion engine 11 has a driven crankshaft which is connected to a transmission input element of the multi-stage transmission 19. The multi-stage transmission 19 is formed by a motor vehicle transmission. The multi-stage transmission 19 forms part of the drive train of the motor vehicle 17. The internal combustion engine 11 comprises at least one valve operating device 10. Preferably, the internal combustion engine 11 comprises several valve operating devices 10. The internal combustion engine 11 is designed as a motor vehicle internal combustion engine which is provided to convert chemical energy into kinetic energy which serves in particular to propel a motor vehicle 17. The internal combustion engine 11 has several cylinders which each have several valves 20, 20'. The internal combustion engine 11 has two valves 20, 20', each designed as inlet valves for one cylinder and two valves each designed as exhaust valves for each cylinder. In principle, it is also conceivable that the internal combustion engine 11 has a different number of valves 20, 20'. Here, the valves 20, 20' are schematically depicted by their actuation plane in FIG. 2.

Figure 2:
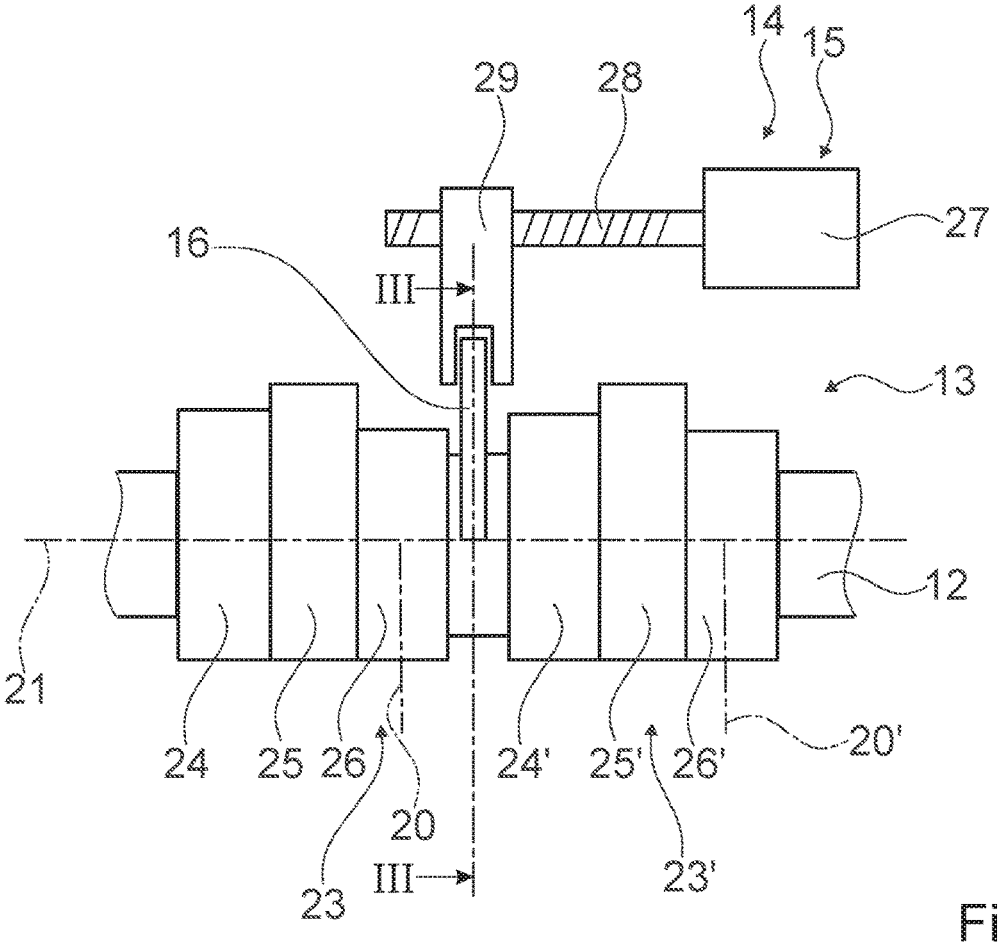
FIG. 2 is a schematic depiction of the valve drive device according to the invention, having a camshaft, a cam unit and an actuator unit.
Figure 3:
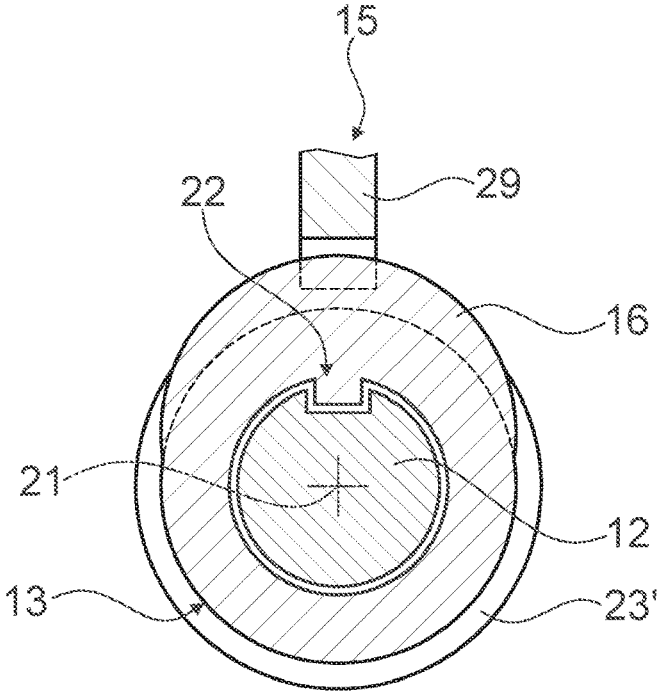
FIG. 3 shows the valve operating device according to the invention having the camshaft, the cam unit and the actuator unit in a schematic sectional depiction along sectional line III-III of FIG. 2.

The valve operating device 10 is provided to actuate the valves 20, 20' of the internal combustion engine 11. The valve operating device 10 has a camshaft 12. The valve operating device 10 has the camshaft 12 for actuating the valves 20, 20'. In FIG. 2, only part of the camshaft 12, which is assigned to a cylinder that is not depicted in detail, is depicted. In addition, the valve operating device 10 has another camshaft which is not depicted in detail. The camshaft 12 depicted is, for example, formed as an intake camshaft, and the camshaft not depicted in detail is an exhaust camshaft. In the following, only the part of the camshaft 12 described in FIGS. 2 and 3 is described in more detail. The description can be applied to the part of the camshaft 12 which is not depicted in detail as well as the camshaft not depicted in detail.

The camshaft 12 is rotatably supported by a camshaft bearing not depicted in detail. For this purpose, the camshaft bearing comprises several support elements fixed to the housing which store the camshaft 12. Here, the camshaft 12 is rotatably mounted about an axis of rotation 21. The axis of rotation 21 of the camshaft 12 is aligned substantially in parallel to an axis of rotation of a crankshaft of the internal combustion engine 11. The camshaft 12 is driven by the crankshaft via a coupling not depicted in detail. The valve operating device 10 comprises one cam unit 13 per cylinder. FIG. 2 shows an example of a cam unit 13. The cam unit 13 is mounted in an axially moveable manner on the camshaft 12. The cam unit 13 is non-rotatably coupled to the camshaft 12. In particular, the cam unit 13 is connected to the camshaft 12 via a toothing 22. The cam unit 13 is provided for actuating the valves 20, 20'. The cam unit 13 has a multi-track cam 23, 23' for each valve 20, 20'. The cam unit 13 has two multi-track cams 23, 23'. Each of the multi-track cams 23, 23' has three cam tracks 24, 24', 25, 25', 26, 26'. In principle, it is also conceivable that the cam unit 13 has only two or more than three cam tracks 24, 24', 25, 25', 26, 26' for each multi-track cam 23, 23'. The cam tracks 24, 24', 25, 25', 26, 26' each have different contours and thus actuate the respective valve 20, 20' with correspondingly different valve strokes. In a first switching position of a cam unit 13, the first cam tracks 24, 24' actuate the respective valve 20, 20'. The valves 20, 20' are actuated with a medium stroke, for example. In a second switching position of the cam unit 13, the second cam tracks 25, 25' actuate the respective valve 20, 20'. The valves 20, 20' are actuated with a large stroke, for example. In a third switching position of the cam unit 13, the third cam tracks 26, 26' actuate the respective valve 20, 20' (FIG. 2). The valves 20, 20' are actuated with a small stroke, for example. The actuation of a valve 20, 20' by a cam track 24, 24', 25, 25', 26, 26' is carried out in a manner known to a person skilled in the art.

Furthermore, the valve operating device 10 has an actuator unit 14. The valve operating device 10 has an actuator unit 14 for adjusting the cam unit 13 on the camshaft 12 between the three switching positions. The actuator unit 14 has an actuator 15. The actuator 15 is formed by a shift actuator. The actuator 15 is provided for adjusting the cam unit 13 on the camshaft 12. The actuator 15 is provided to move the cam unit 13 axially on the camshaft 12 in order to bring the different cam tracks 24, 24', 25, 25', 26, 26' of the multi-track cams 23, 23' into engagement with the respective valve 20, 20'. Here, the actuator 15 is designed as an electronically controlled unit. The actuator 15 comprises an electric motor 27 and a spindle 28, which can be driven by the electric motor 27 in both directions of rotation. To convert the rotation of spindle 28 into a linear movement, the actuator 15 has a switching element 29. The switching element 29 is designed as a threaded nut. The switching element 29 has an internal thread not depicted in detail, via which the switching element 29 is supported on the spindle 28. By rotating the spindle 28 by means of the electric motor 27, the switching element 29 can be shifted in the axial direction of spindle 28. Instead of a spindle 28, a guide rail or a cable device can be used as a support for the switching element 29. The actuator 15 is arranged in parallel offset to the camshaft 12.

The cam unit 13 also has an engagement element 16. The cam unit 13 is coupled to the actuator unit 14 via the engagement element 16. The cam unit 13 is coupled to the actuator 15 via the engagement element 16. The axially moveable switching element 29 of the actuator 15 is operatively connected to the engagement element 16. The engagement element 16 is designed as a narrow peripheral gill. The actuating element 16 is partially interrupted along a periphery of the cam unit 13. The actuating element 16 is interrupted in the peripheral direction of the cam unit 13. Thus in the peripheral direction around the cam unit 13, the engagement element 16 does not extend completely around the cam unit 13. The engagement element 16 is designed as a gill. The engagement element 16 is formed by a gill rotating around 180° of the periphery. The engagement element 16 is formed by a crescent-shaped gill. The engagement element 16 is designed as a crescent moon-shaped gill. In principle, however, a different design of the engagement element 16, which would appear useful to a person skilled in the art, would also be conceivable. The engagement element 16 is designed without an incline in the axial direction and has a constant width in the peripheral direction of the camshaft 12. The engagement element 16 is arranged between the multi-track cams 23, 23' of the cam unit 13. The switching element 29 is temporarily connected positively to the engagement element 16. For this purpose, the switching element 29 has a recess in which the engagement element 16 formed as a gill engages. The engagement element 16 forms an interface for applying a displacement force acting in the axial direction to the cam unit 13. In the exemplary embodiment shown, the displacement force acting in the axial direction is only applied by the actuator 15. It is independent of a rotational movement of the camshaft 12.

The actuator 15 is periodically mechanically forcibly decoupled during operation. During operation, the actuator 15 is periodically temporarily decoupled from the cam unit 13 relative to a speed of the camshaft 12. During operation, the actuator 15 is periodically temporarily forcibly decoupled from the cam unit 13 relative to an angle of rotation of the camshaft 12. Furthermore, the actuator 15 is always temporarily forcibly decoupled from the cam unit 13 when the cam unit 13 should not be adjusted, i.e., especially when the valves 20, 20' are being operated by the cam unit 13. The forced decoupling is carried out mechanically by means of the engagement element 16. The engagement element 16 has the interruption for this purpose. The interruption has such an arrangement that, when the interruption is facing the actuator 15, the cam unit 13 is actuating the valves 20, 20'. The interruption thus always faces the actuator 15 when the cam unit 13 should not be adjusted, especially when at least the valves 20, 20' are operated by the cam unit 13. In a position facing the actuator 15, the interruption causes a forced decoupling of the actuator 15. The actuator 15 is therefore temporarily disengaged from the engagement element 16 during operation. The switching element 29 of the actuator 15 is temporarily disengaged from the engagement element 16 during operation. The switching element 29 of the actuator 15 is always disengaged from the engagement element 16 if the cam unit 13 should not be adjusted.

At each half camshaft revolution—whenever a switchover is mechanically possible the engagement element 16 enables an interaction between the actuator 15 and the cam unit 13. Whenever an attempt to switch over could lead to damage, no traction between the actuator 15 and the cam unit 13 is possible. This can prevent an incorrectly timed adjustment of the cam unit 13.

To actuate the actuator 15, the valve operating device 10 has a control and regulating unit which is not depicted in detail. The control unit is intended to control the electric motor 27 of the actuator 15 and thereby actuate the actuator 15. The control and regulating unit is designed as part of a motor control. In principle, it is also conceivable that the control and regulating unit is designed as a separate control unit. By controlling the control and regulating unit, the electric motor 27 of the actuator 15 can be driven in both directions, allowing the switching element 29 to be moved in both axial directions.

LIST OF REFERENCE CHARACTERS

10 valve operating device
11 internal combustion engine
12 camshaft
13 cam unit
14 actuator unit
15 actuator
16 engagement element
17 motor vehicle
18 drive wheel
19 multi-stage transmission
20 valve
21 rotation axis
22 toothing
23 cam
24 cam track
25 cam track
26 cam track
27 electric motor
28 spindle
29 switching element

The invention claimed is:

1. A valve operating device for an internal combustion engine, comprising:

a camshaft;

a cam unit mounted on the camshaft in an axially moveable manner; and an actuator unit which has an actuator having an electric motor and a spindle for adjusting the cam unit;

wherein the camshaft is connected by toothing to an engagement element via which the cam unit is coupled to the actuator unit;

wherein, by rotating the spindle using the electric motor, a switching element is shiftable in an axial direction of the spindle and axially relative to the camshaft; and wherein the switching element periodically mechanically decouples from the engagement element and is always disengaged from the engagement element when the cam unit is not adjusted, thereby periodically temporarily forcibly decoupling the actuator from the cam unit during operation relative to a rotational angle of the camshaft and always decoupling the actuator from the cam unit while valves are being operated by the cam unit.

2. The valve operating device according to claim 1, wherein the engagement element is partially interrupted along a circumference of the cam unit.

3. The valve operating device according to claim 1, wherein the engagement element is a crescent-shaped gill.

4. A motor vehicle, comprising:

an internal combustion engine; and the valve operating device according to claim 1.

* * * * *